US009238542B2

(12) United States Patent
Bollis

(10) Patent No.: US 9,238,542 B2
(45) Date of Patent: Jan. 19, 2016

(54) BEVERAGE CAN HOLDER AND COOLER TECHNOLOGY

(71) Applicant: Christopher Wartman Bollis, Wayzata, MN (US)

(72) Inventor: Christopher Wartman Bollis, Wayzata, MN (US)

(73) Assignee: DoubleUp, LLC, Wayzata, MN (US)

( * ) Notice: Subject to any disclaimer, the term of this patent is extended or adjusted under 35 U.S.C. 154(b) by 0 days.

(21) Appl. No.: 14/267,057

(22) Filed: May 1, 2014

(65) Prior Publication Data

US 2014/0231441 A1 Aug. 21, 2014

Related U.S. Application Data

(63) Continuation of application No. 13/188,669, filed on Jul. 22, 2011, now Pat. No. 8,720,739.

(60) Provisional application No. 61/400,080, filed on Jul. 22, 2010.

(51) Int. Cl.
*B65D 81/38* (2006.01)
*F25D 3/08* (2006.01)

(52) U.S. Cl.
CPC ..... *B65D 81/3876* (2013.01); *B65D 81/3879* (2013.01); *B65D 81/3886* (2013.01); *F25D 3/08* (2013.01); *F25D 2331/805* (2013.01)

(58) Field of Classification Search
CPC ..... B65D 81/3886; B65D 81/3883; B65D 81/3881; B65D 81/3879; B65D 81/3876; F25D 3/08; F25D 3/06; F25D 2231/805
USPC ..... 220/739, 737, 903, 592.27, 23.88, 220/DIG. 9; 215/395; 206/223, 430, 427; 62/457.7, 457.4, 457.5, 457.2; D9/455; D7/619.1, 608, 607, 605, 602
See application file for complete search history.

(56) References Cited

U.S. PATENT DOCUMENTS

| | | | | |
|---|---|---|---|---|
| 2,473,429 | A * | 6/1949 | Hinman | 206/162 |
| 3,473,682 | A | 10/1969 | Studen | |
| 4,534,391 | A | 8/1985 | Ventimiglia et al. | |
| 4,940,141 | A | 7/1990 | Philpot | |
| 5,259,529 | A | 11/1993 | Coale | |
| 5,730,353 | A | 3/1998 | Holley, Jr. | |
| 7,337,915 | B1 | 3/2008 | Weldon | |
| 2004/0232156 | A1 | 11/2004 | Hogan et al. | |
| 2005/0150800 | A1 | 7/2005 | Lown et al. | |
| 2005/0230586 | A1 | 10/2005 | Gary | |
| 2007/0158225 | A1 | 7/2007 | Stephens | |
| 2011/0067361 | A1 | 3/2011 | Sloan | |

* cited by examiner

*Primary Examiner* — Robert J Hicks
(74) *Attorney, Agent, or Firm* — Skinner and Associates; Joel D. Skinner

(57) ABSTRACT

A cooler for holding two cans, particular beverage cans containing beer, soft drinks or the like, in a stacked or tandem arrangement. The cooler holds the cans snuggly, keeping them safe from bumps and the like, and also insulates the cans to preserve cold or hot temperature of can contents as long as practicable. The cooler has a cylindrical configuration including a body with an open top, a closed bottom, and as interior space. The body has a cylindrical sleeve and a bottom, which is either in the form of a separate panel or unitary with the sleeve. The bottom has an aperture for preventing or reducing vacuum on the inside of the cooler. A method of using the cooler is also disclosed.

18 Claims, 6 Drawing Sheets

BEVERAGE CAN HOLDER AND COOLER TECHNOLOGY

CROSS-REFERENCE TO RELATED APPLICATIONS, IF ANY

This application claims the benefit under 35 U.S.C. §119 (e) of co-pending U.S. patent application Ser. No. 13/188,669, filed on Jul. 22, 2011, status allowed, which claims the benefit of U.S. Provisional Patent Application Ser. No. 61/400,080, filed Jul. 22, 2010, which is hereby incorporated by reference.

37 C.F.R. §1.71(e) AUTHORIZATION

A portion of the disclosure of this patent document contains material which is subject to copyright protection. The copyright owner has no objection to the facsimile reproduction by anyone of the patent document or the patent disclosure, as it appears in the US Patent and Trademark Office patent file or records, but otherwise reserves all copyright rights whatsoever.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to beverage can holding and cooling systems, apparatus and methods. Particularly, the invention relates to a novel can cooler.

2. Background Information

Existing technology in this field is believed to have significant limitations and shortcomings. For this and other reasons, a need exists for the present invention.

In one embodiment, the invention provides a cooler for holding two cans, particular beverage cans containing beer, soft drinks or the like, in a stacked or tandem arrangement. The cooler holds the cans snuggly, keeping them safe from bumps and the like, and also insulates the cans to preserve cold or hot temperature of can contents as long as practicable. The cooler has a cylindrical configuration including a body with an open top, a closed bottom, and an interior space. The body has a cylindrical sleeve and a bottom, which is either in the form of a separate panel or unitary with the sleeve. The bottom has an aperture for preventing or reducing vacuum on the inside of the cooler caused by tight fitting cans.

All US patents and patent applications, and all other published documents mentioned anywhere in this application are incorporated by reference in their entirety.

BRIEF SUMMARY OF THE INVENTION

The invention provides a can cooler apparatus and method which are practical reliable, and efficient and which are believed to fulfill the need and to constitute an improvement over the background technology.

In one aspect, the invention provides a container holder for holding two cylindrical containers, the holder comprising a body having a predetermined length and cylindrical interior dimension enclosing an interior cavity, the body having a dosed end and an open end, the holder adapted to hold two cylindrical containers in an in-line orientation whereby a portion of one of the containers is exposed at the open end of the body.

In another aspect, the invention provides a method of holding a pair of cylindrical containers comprising the steps of:

a. providing a holder comprising for holding two cylindrical containers, the holder comprising a body having a predetermined length and cylindrical interior dimension enclosing an interior cavity, the body having a closed end and an open end;

b. inserting a first cylindrical container in the open end of the holder; and c. inserting a second cylindrical container in the open end of the holder, whereby the cylindrical containers in an in-line orientation so that a portion of one of the second cylindrical container is exposed at the open end of the body.

The aspects, features, advantages, benefits and objects of the invention will become clear to those skilled in the art by reference to the following description, claims and drawings.

DETAILED DESCRIPTION

Figure 1:
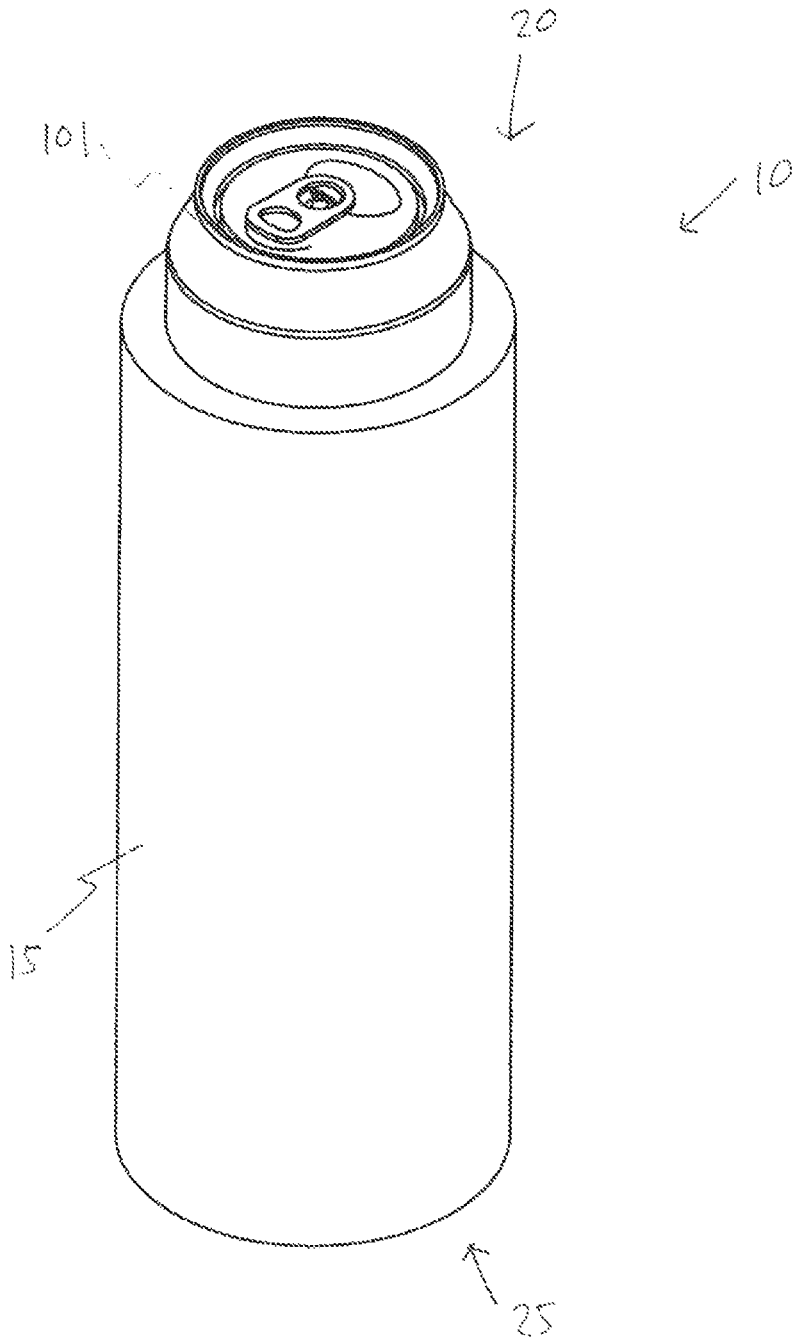
FIG. 1 is a perspective view of an embodiment of the can cooler of the present invention, including cans.
Figure 2:
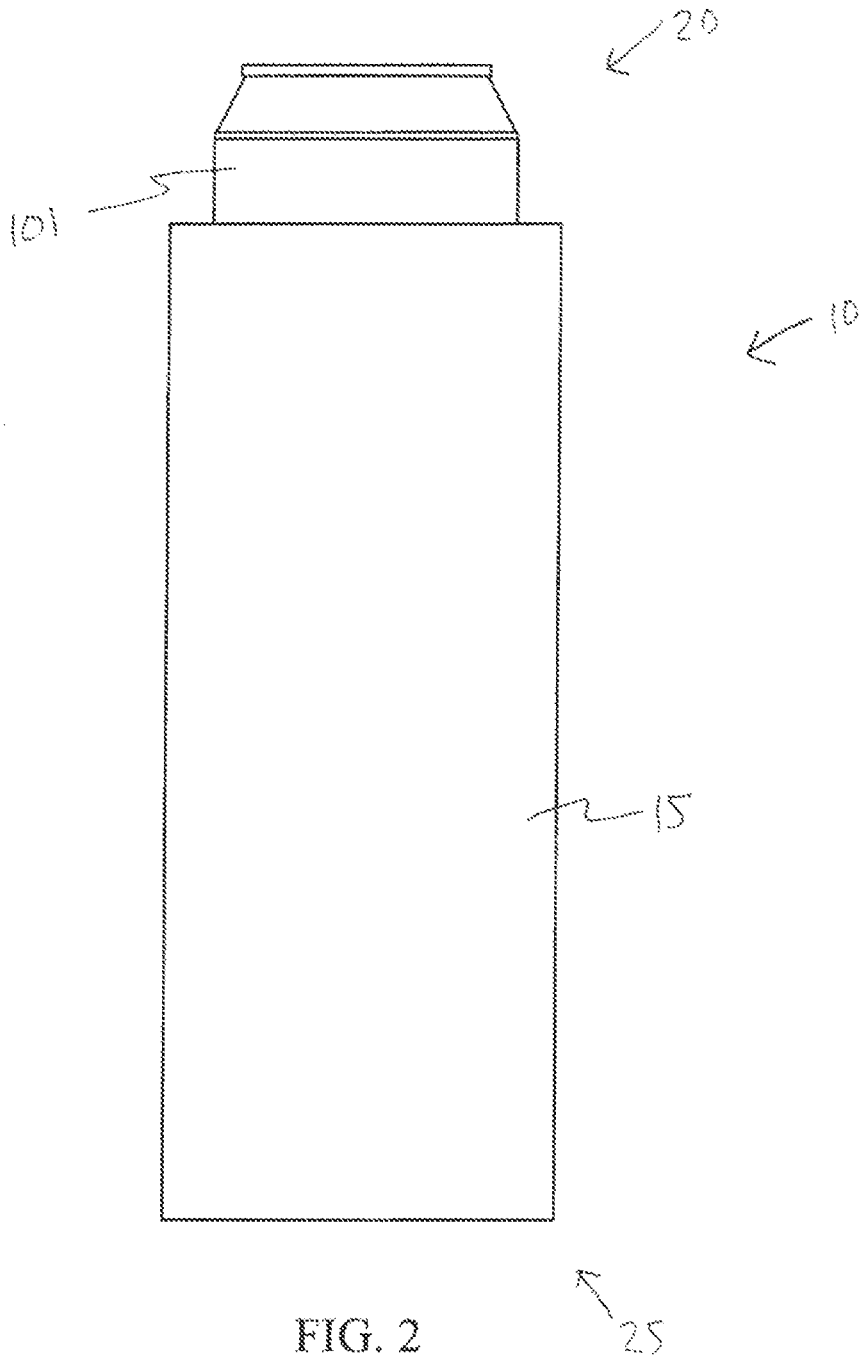
FIG. 2 is a front elevation view of the can cooler, the back and side views being substantially similar thereto.

FIGS. 1 and 2, show an embodiment of a holder 10 for beverage cans of the present invention. The beverage can holder or "cooler" 10 is for holding two (2) containers, particularly cans, particular beverage cans containing beer, soft drinks, water, juice or the like. The cooler 10 embodiment shown is for twelve (12) ounce beverage cans that are common in the United States. Such cans are typically constructed of Aluminum and have standard dimensions. The cooler 10 holds the cans snuggly, keeping them sale from bumps and the like, and also insulates the cans to preserve cold or hot temperature of can contents as long as practicable.

Figure 3:
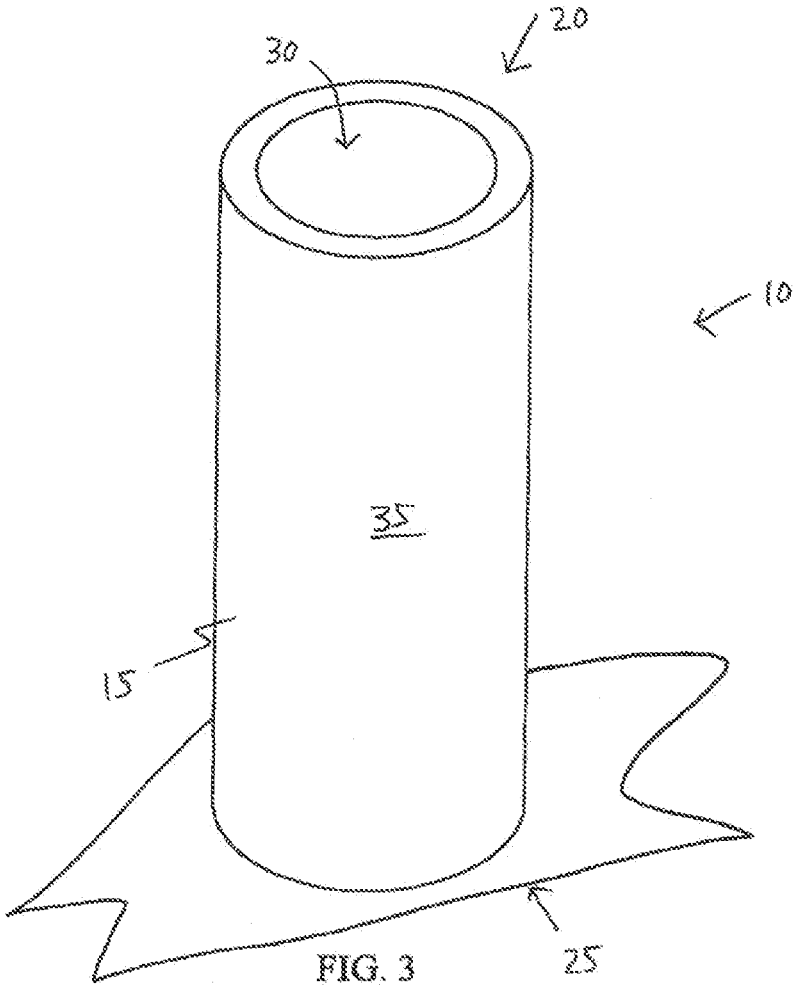
FIG. 3 is a perspective view of the can cooler showing a portion of the interior thereof.
Figure 4:
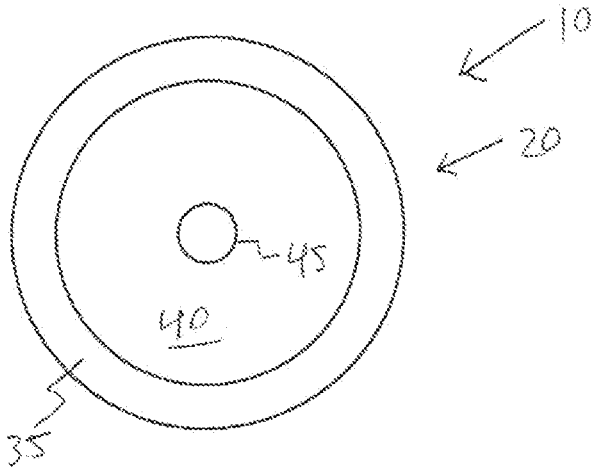
FIG. 4 is a top, elevation view of the can cooler.
Figure 5:
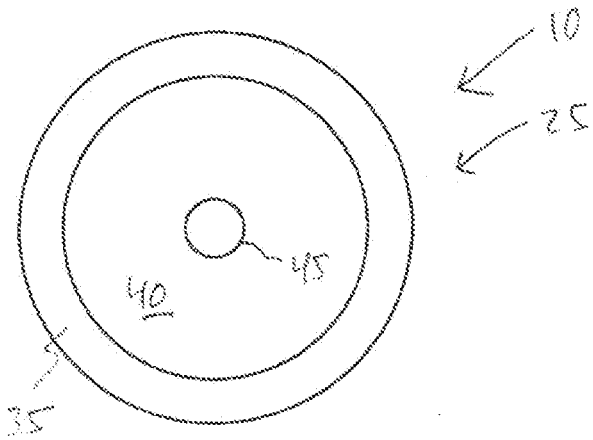
FIG. 5 is a bottom view of the can cooler.

The cooler 10 is preferably has a cylindrical configuration. The cooler has a body 15 with an open first end or top 20, a closed second end or bottom 25 and an interior space or cavity 30. The body 15 is shown to have a cylindrical sleeve 35 and a bottom panel 40. However, it is within the purview of the invention that the body have a unitary structure. As best shown in FIG. 5, the bottom 25 has an aperture 45 for preventing or reducing vacuum on the inside of the cooler 10 caused by tight fitting cans. The aperture 45 may be blocked or unblocked by the finger of the user to create or reduce air pressure at the bottom of the cavity 30. In an alternative embodiment, the bottom may have a plurality of apertures including for example a large central aperture and a pair of smaller satellite apertures. It should be understood that the top 20 and bottom 25 of the holder 50 shown in FIGS. 1-3 may be reversed or otherwise changed in space in use by the user during the normal course of loading, unloading, transposition, carrying or drinking. So, for example, the top 20 of the holder 10 may in fact be disposed below the bottom 25, in space, at times.

The cooler 10 is constructed of a flexible insulative material. A preferred material is a synthetic rubber material, most preferably polychloroprene (Neoprene). A most preferred material is 9 mm Neoprene.

Figure 6:
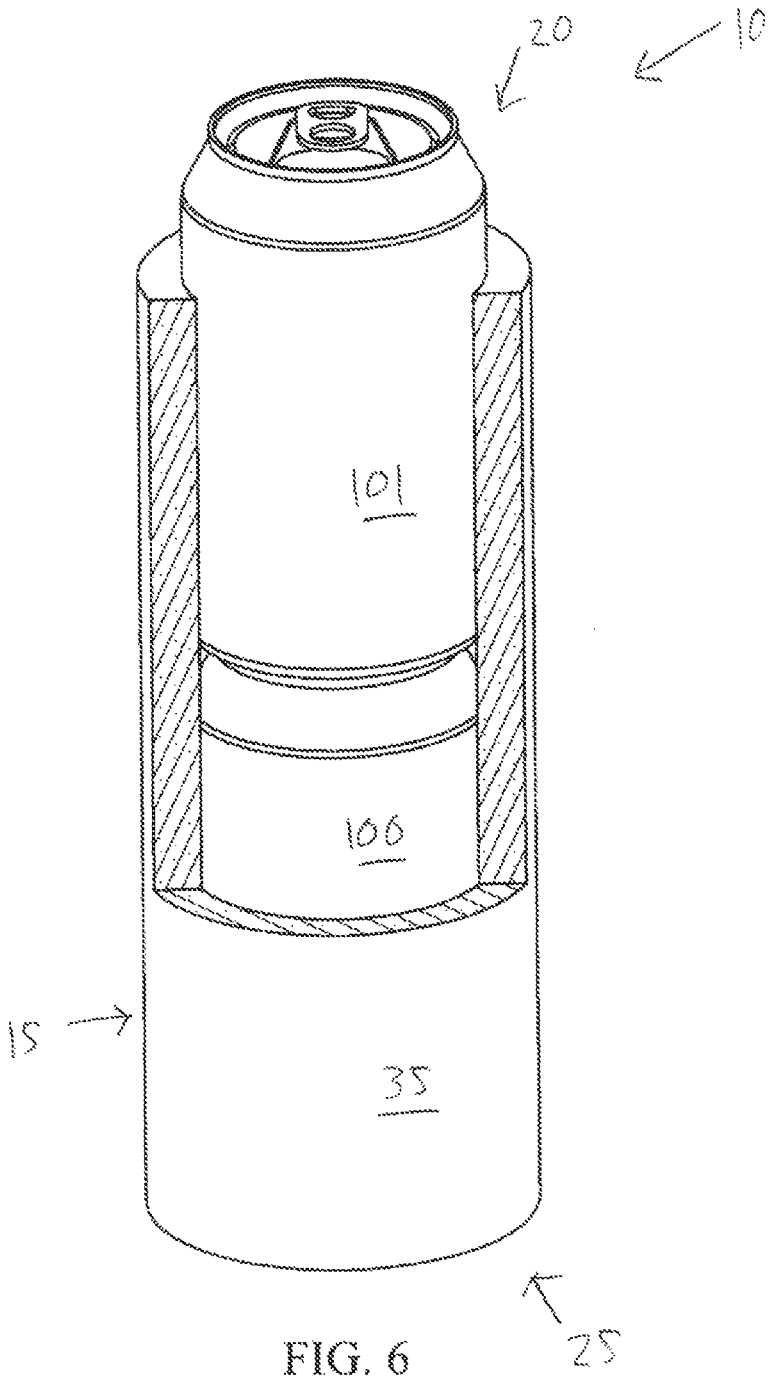
FIG. 6 is a perspective view of the can cooler, partially in section showing cans in the interior of the cooler.

Referring also to FIG. 6, in one embodiment of the cooler 10 for holding and cooling standard 12 fluid ounce (355 ml) beverage cans, the cooler 10 has a length or height of 8¾ inch (22.25 cm.) and an outside diameter of 3¼ inch (8 cm.). The thickness of the body material 15 is approximately ⅜ inch (9 mm). This provides an inside diameter of 2½ inch (6.5 cm) and an inside length of 8½ inch (21.5 cm).

The long body 15 provides a large, clean area, commonly called an "ad panel", for placement of graphics, designs, and advertisements.

Figure 7:
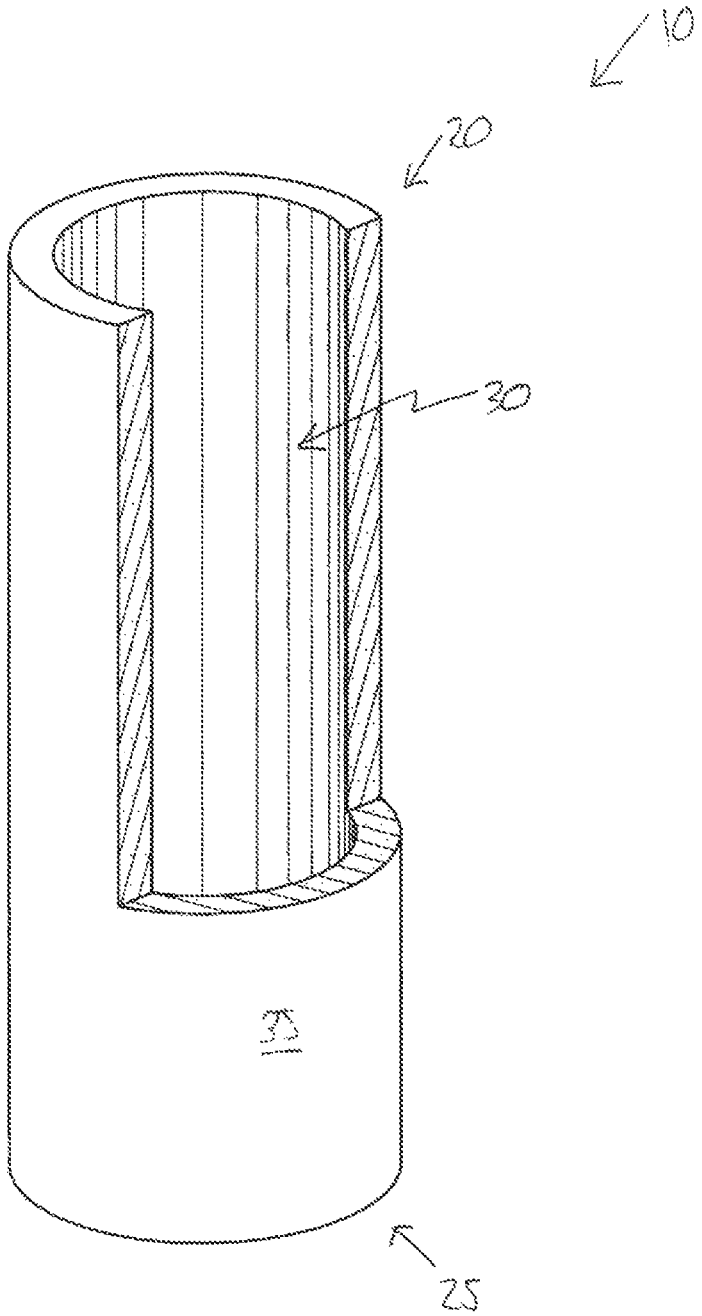
FIG. 7 is a perspective view of the can cooler, partially in section showing a portion of the interior of the cooler.

Referring to FIGS. 6 and 7, in use, the cooler is loaded by inserting a pair of cans 100 and 101 into the cooler 10 via the open top so that they are ultimately arranged in tandem or stacked. The cans 100 and 101 are lined up with each other one 101 on top 100 of the other. The cans 100 and 101 are preferably lined up (disposed in-line) facing the same direction with the tops of the cans facing toward the open end 20. Alternatively, the bottom can 100 may face downwardly. In other words, the top or drinking end of can 100 may face downwardly toward the bottom 25 of the cooler 10. In use, bottom can 100 is inserted first and pushed downwardly until it engages the bottom of the interior. Top can 101 is inserted next and pushed downwardly until it engages the top of the bottom can 100. The cans are preferably full and closed when inserted. When both of the standard size cans (outside dimensions 5 inches long and 2½ inches maximum diameter) are inserted top can 101 protrudes from the top 20 of the cooler 10 a predetermined distance, preferably about 1 inch. The snugness of the interior permits the cooler 10 to hold a single can. The aperture 45 permits venting of air out the bottom 25 as cans 100 and 101 are inserted.

After loading, the cooler 10 may be held (in one hand) or placed by the user for an extended period of time with a reduction in warming of the beverage contents, or a cooling in the case of warm beverages. The cooler 10 also make it easier and more convenient for a user to hold and transport a pair of cans and to protect such cans from drops, bumps, spills and the like. By virtue of having a higher volume of beverages (which are maintained at a desired temperature), the user need not return to a kitchen, refrigerator, large volume cooler or the like to replenish his or her supply of beverages.

The top can 101 is opened and consumed in due course. In one embodiment of the method of use, the top can 101 is removed from the cooler 10 and disposed of appropriately. The bottom can 100 is then moved up so that it extends from the top of the cooler 30 and may be opened and conveniently consumed.

In an alternative embodiment of the method of use, the top can 101 is removed from the cooler 10, the bottom can 100 is also removed, and then the top can 101 is then re-inserted into the cooler 10 to serve as a base for the re-inserted can 100. Can 100 now extends from the top of the cooler 10 and may be opened and conveniently consumed.

The benefits of the invention include, but are not necessarily limited to:

Easy to hold, consume and transport a higher volume of beverage.

Longer provision of cold or hot beverages.

Reduce the need to return to a kitchen, refrigerator or cooler to re-supply beverages thus permitting the user to remain at the activity in which they are engaged.

Larger ad panel for logos, designs, advertisements and the like.

The embodiments above are chosen, described and illustrated so that persons skilled in the art will be able to understand the invention and the manner and process of making and using it. The descriptions and the accompanying drawings should be interpreted in the illustrative and not the exhaustive or limited sense. The invention is not intended to be limited to the exact forms disclosed. While the application attempts to disclose all of the embodiments of the invention that are reasonably foreseeable, there may be unforeseeable insubstantial modifications that remain as equivalents. It should be understood by persons skilled in the art that there may be other embodiments than those disclosed which fall within the scope of the invention as defined by the claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

The invention claimed is:

1. A container holder for holding two cylindrical containers, the holder comprising a body having a predetermined length and cylindrical interior dimension enclosing an interior cavity, the body having a closed end and an open end, the holder adapted to hold two cylindrical containers in an in-line orientation whereby a portion of one of the containers is exposed at the open end of the body, the container holder being adapted to hold and insulate two beverage cans, one can being completely disposed within the interior cavity for insulation and portability, and the other being partially disposed within the cavity for insulation, portability and ready access for consuming the contents thereof, whereby the user can easily insulate, hold and transport twice the amount of beverage in a single container.

2. The container holder of claim 1, wherein the body is constructed of an insulating material.

3. The container holder of claim 2, wherein the insulating material is a flexible synthetic rubber or foam.

4. The container holder of claim 3, wherein the material is Neoprene.

5. The container holder of claim 4, wherein the Neoprene material is approximately 9 mm thick.

6. The container holder of claim 1, wherein the body has an elongated, cylindrical wall and a circular wall disposed at and forming the closed end.

7. The container holder of claim 6, wherein the circular wall is unitary with the cylindrical wall.

8. The container holder of claim 6, wherein the circular will is non-unitary with the cylindrical wall, the circular wall being connected to the cylindrical wall via an adhesive or a weld.

9. The container holder of claim 6, wherein the circular wall has an aperture disposed in it.

10. The container holder of claim 1, wherein the exterior of the cylindrical wall is cylindrical.

11. The container holder of claim 1, wherein the length of the body is slightly less than the length of two containers which are to be held by the holder so that a predetermined portion of the top of one of the containers is exposed for access by a user.

12. The container holder of claim 11, wherein the body is length of 8.75 inches.

13. The container holder of claim 1, wherein the cylindrical body interior has a diameter that is substantially equivalent to the exterior diameter of a cylindrical container to be held.

14. The container holder of claim 13, wherein the interior diameter is 2.5 inches.

15. The container holder of claim 1, wherein the exterior of the body has an ad panel.

16. A container holder for holding two cylindrical beverage can containers, the holder comprising a cylindrical body constructed of a flexible, insulative material and having a predetermined length of slightly less than the length of the two containers and cylindrical interior diameter substantially equivalent to the outer diameter of one of the container enclosing an interior cavity, the body having a closed end and an open end, the body having an elongated cylindrical wall and a circular bottom, the holder adapted to hold two cylindrical beverage can containers in an in-line orientation whereby a portion of one of the beverage can containers is exposed at the open end of the body for consumption of the contents thereof.

17. A method of holding a pair of cylindrical containers comprising the steps of:

a. providing a holder for holding two cylindrical containers, the holder comprising a body having a predetermined length and cylindrical interior dimension enclosing an interior cavity, the body having a dosed end and an open end, wherein the holder cylindrical body is constructed of a flexible, insulative material and having a predetermined length of slightly less than the length of the two containers and cylindrical interior diameter substantially equivalent to the outer diameter of one of the container enclosing an interior cavity, the body having an elongated cylindrical wall and a circular bottom, the holder adapted to hold two cylindrical beverage can containers in an in-line orientation whereby a portion of one of the beverage can containers is exposed at the open end of the body for consumption of the contents thereof:

b. inserting a first cylindrical container in the open end of the holder; and c. inserting a second cylindrical container in the open end of the holder, whereby the cylindrical containers are in-line orientation and so that a portion of the top of the second cylindrical container is exposed at the open end of the body.

18. The method of holding a pair of containers of claim 17, adapted to hold and insulate two beverage cans, one can being completely disposed within the interior cavity for insulation and portability, and the other being partially disposed within the cavity for insulation, portability and ready access for consuming the contents thereof, whereby the user can easily insulate, hold and transport twice the amount of beverage in a single container.

* * * * *